US005178529A

United States Patent [19]

Obrist et al.

[11] Patent Number: 5,178,529

[45] Date of Patent: Jan. 12, 1993

[54] SEAL FORMED OF PLASTIC LAYER HAVING OUTWARDLY OPEN DEPRESSIONS

[75] Inventors: Frank Obrist, Dornbirn, Austria; Peter Kuhn, Weinheim; Michael Frey, Lindau, both of Fed. Rep. of Germany

[73] Assignee: TES Wankel Technische Forschungs- und Entwicklungsstelle, Lindau, Fed. Rep. of Germany

[21] Appl. No.: 792,034

[22] Filed: Nov. 13, 1991

[30] Foreign Application Priority Data

Dec. 28, 1990 [CH] Switzerland ..... 4138/90

[51] Int. Cl.[5] ..... F01C 19/00; F16J 15/453

[52] U.S. Cl. ..... 418/141; 418/153; 418/178; 277/53

[58] Field of Search ..... 418/56, 141, 153, 178; 277/53; 415/170.1, 174.5, 229, 230

[56] References Cited

U.S. PATENT DOCUMENTS

| | | | |
|---|---|---|---|
| 2,492,935 | 12/1949 | McCulloch et al. | 418/178 |
| 3,558,246 | 1/1971 | Philipp | 418/178 |
| 4,012,180 | 3/1977 | Berkowitz et al. | 418/141 |
| 4,028,021 | 6/1977 | Berkowitz | 418/141 |
| 4,846,642 | 7/1989 | Nuber et al. | 418/178 |

FOREIGN PATENT DOCUMENTS

| | | | |
|---|---|---|---|
| 3621178 | 1/1988 | Fed. Rep. of Germany . | |
| 59-224402 | 12/1984 | Japan | 418/141 |
| 207907 | 4/1940 | Switzerland | 418/178 |
| 2131877 | 6/1984 | United Kingdom | 418/141 |

*Primary Examiner*—John J. Vrablik
*Attorney, Agent, or Firm*—Ladas & Parry

[57] ABSTRACT

The seal or pattern between two machine parts has on one of the sealing gap-forming, facing surfaces (5) a plastic layer (1) with closely juxtaposed depressions (8) which have the form of partly cut off voids of an expanded plastic structure. They are formed by the removal of a plastic layer (3) expanded on the machine part, the layer thickness being so uniformly reduced that the voids (4) of the bottom void layer (4) adjacent to the base surface (5) of the machine part are open. This avoids the insulating action of the closed voids of an expanded plastic layer and the latter has a very limited weight, which avoids any risk of the layer being detached or separated due to centrifugal forces. Moreover, in simple manner, a honeycomb-like, open surface structure is obtained, so that there is a labyrinth effect in the sealing gap. In order to obtain minimum, sealing gaps by running in the open, honeycomb-like surface structure is particularly advantageous, because the solely linear contact which occurs ensures a rapid running in of the mating surface, which can be abrasively prepared. The seal or packing is particularly suitable for very rapidly rotating machine parts.

8 Claims, 9 Drawing Sheets

Fig.5
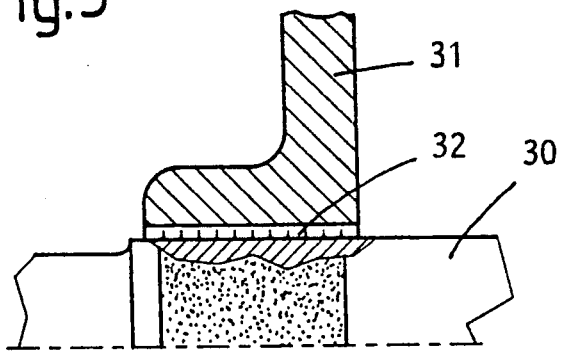
Fig.6
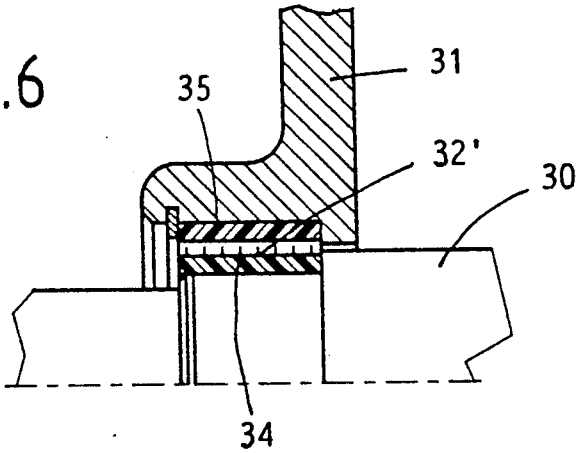
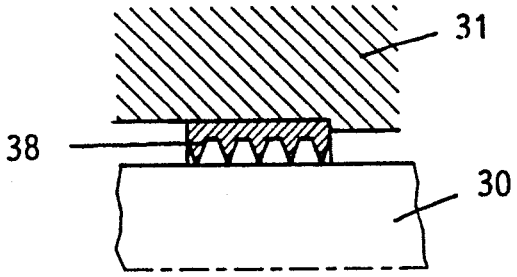
Fig.8
PRIOR ART
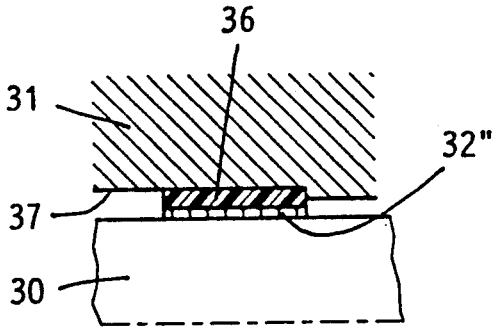
Fig.7

SEAL FORMED OF PLASTIC LAYER HAVING OUTWARDLY OPEN DEPRESSIONS

BACKGROUND OF THE INVENTION

The invention relates to a seal between two parts moved relative to one another through their sealing gap-forming approximation, with an outer plastic layer on one of the sealing gap-forming, facing surfaces.

Seals or packings of this type are e.g. known from DE-A-33 26 852, DE-A-36 21 178, EP-A-0 109 823 and EP-A-0 267 559. By the trueing of the parts on one another, the plastic layer thereof serves to allow an automatic formation of a very narrow sealing gap. This literature discloses that difficulties are encountered in preventing a detachment of the plastic layer due to centrifugal forces and that it is not possible to obtain a sufficiently thin layer to bridge the gaps necessary as a result of manufacturing tolerances and allow a running in on the entire, desired surface.

To obviate the problem of separation or detachment due to centrifugal forces, according to EP-A-0 267 559 the plastic layer applied in a mould is only located on the inwardly directed faces of a rotary machine, so that the centrifugal forces have a pressing action on the plastic layer.

The known seals of the aforementioned type also lead to the disadvantage that when used on machines with varying thermal stresses, e.g. for boosting internal combustion engines, the sought narrow sealing gaps cannot be obtained as a result of the thermal insulation action of the porous plastic layer. This insulating action means that the part carrying the plastic layer cannot follow without a time lag the thermal expansions of the adjacent, other part occurring on putting the machine into operation and after switching it off. Thus, in a rotary machine, the surrounding casing cools first and then shrinks on the still hot, enclosed rotor, so that the plastic layer thereof is excessively ground or worn away. On heating the machine the casing firstly expands, so that compared with the still cold rotor correspondingly wide gaps occur on the seal.

The problem of the invention is to find a seal of the aforementioned type, which can be easily manufactured, which permits narrow sealing gaps and which has an improved, reliable action.

SUMMARY OF THE INVENTION

According to the invention this problem is solved in that outwardly open depressions are provided in closely juxtaposed form in the outer plastic layer and have the form of partly cut off voids of an expanded plastic structure, which extend at least close to the base surface and most of the plastic layer is substantially free from closed voids.

The plastic layer of the inventive seal is produced by the expansion of a plastic layer and the subsequent reduction of its thickness by removal to such an extent that the voids adjacent to the base surface form outwardly open depressions.

The invention is based on the finding that the voids of a not yet expanded plastic layer adjacent to the base surface substantially all have the same very limited spacing from said base surface, so that the numerous depressions obtained after removing part of the layer form a heat transfer-aiding, open connection at least up to the vicinity of the base surface. The strong insulating action of an expanded plastic is consequently avoided, without any concomitant loss of the low specific weight and the possibility of trueing the adjacent machine part on said plastic layer.

The small remaining plastic quantity compared with the layer thickness leads to lower centrifugal forces on the plastic layer and consequently to low stresses on its adhesive surface, so that the risk of separation is greatly reduced.

By fixing the size of the voids for the formation of the depressions on the basis of the choice of the known, necessary process conditions, the plastic layer can be made so thick that following the assembly of the particular machine part, it initially bridges the gap on the seal required for manufacturing reasons, until during the running in of the machine and the trueing of the parts on one another an ideal gap width is obtained between these parts. It can be advantageous for this purpose to abrasively prepare certain surfaces of the counterengagement parts or the counterrolling parts. The automatic running in takes place in a very short time, because it is only necessary to partly abrade away the narrow, diaphragm-like partitions between the depressions with linear contact. Damage to the abrasively acting surfaces is avoided.

In addition, an advantageous effect can be obtained in that the depressions together form a honeycomb-like surface structure and consequently there is a much better sealing action in the sealing gap as a result of the labyrinth effect obtained.

Advantageously the plastic layer having the depressions is provided on the surface regions of a rotary machine part, on which the centrifugal force is directed away from the machine part, so that the depressions are open in the direction of the centrifugal force and contaminants can be discharged therefrom. This improves the reliability or durability of the seal.

BRIEF DESCRIPTION OF THE DRAWINGS

Advantageous developments and uses of the invention form the subject matter of the dependent claims and the invention is described hereinafter relative to a non-limitative embodiment and the attached drawings, wherein show:

FIGS. 5 to 7: Axial sections through shaft packings according to the invention.

FIG. 8: An axial section through a known labyrinth packing.

DESCRIPTION OF A PREFERRED EMBODIMENT

Figure 1:
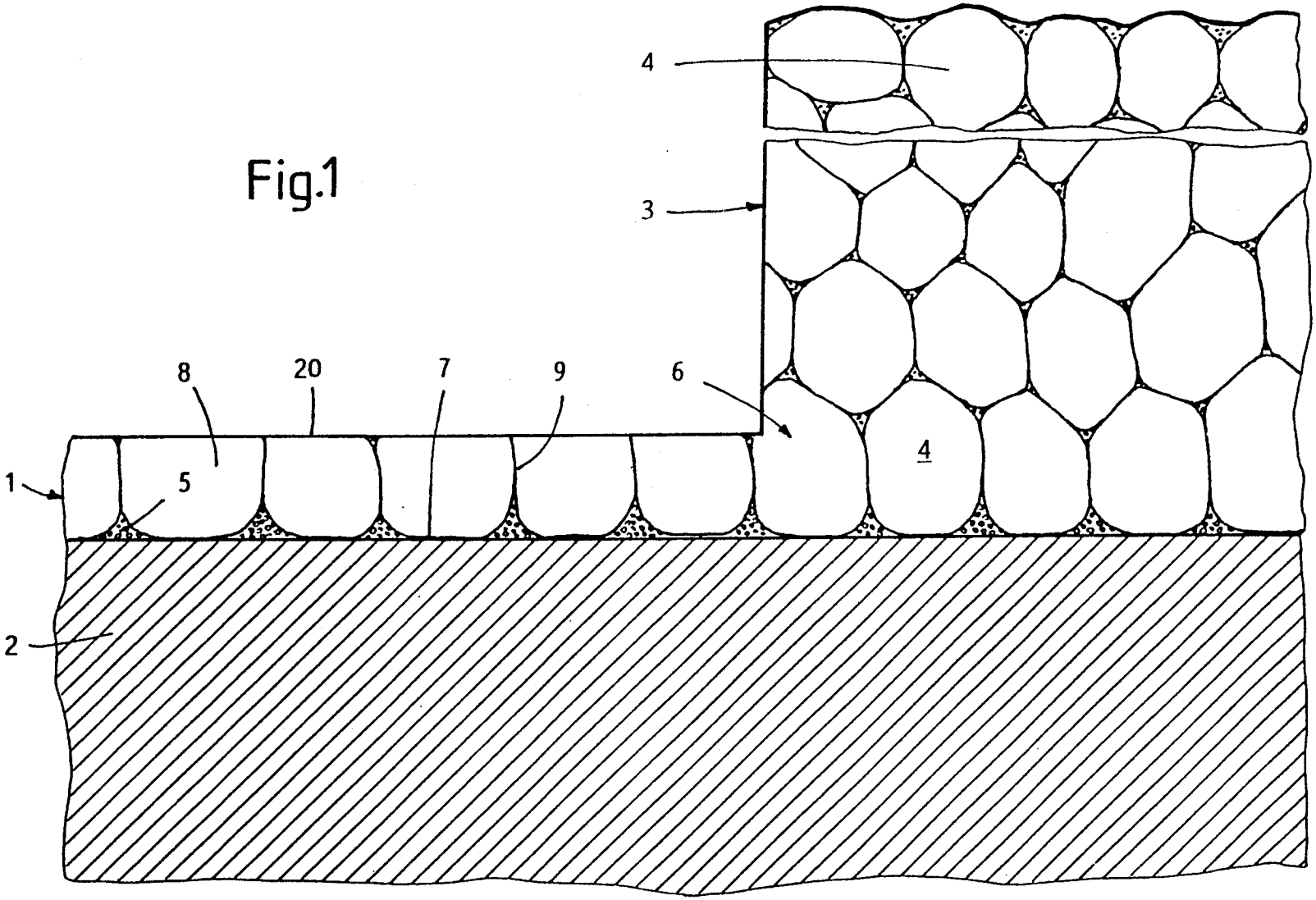
FIG. 1: A larger-scale sectional representation of an area of a machine part carrying the plastic layer and at right angles to the surface thereof, with the layer partly removed.
Figure 2:
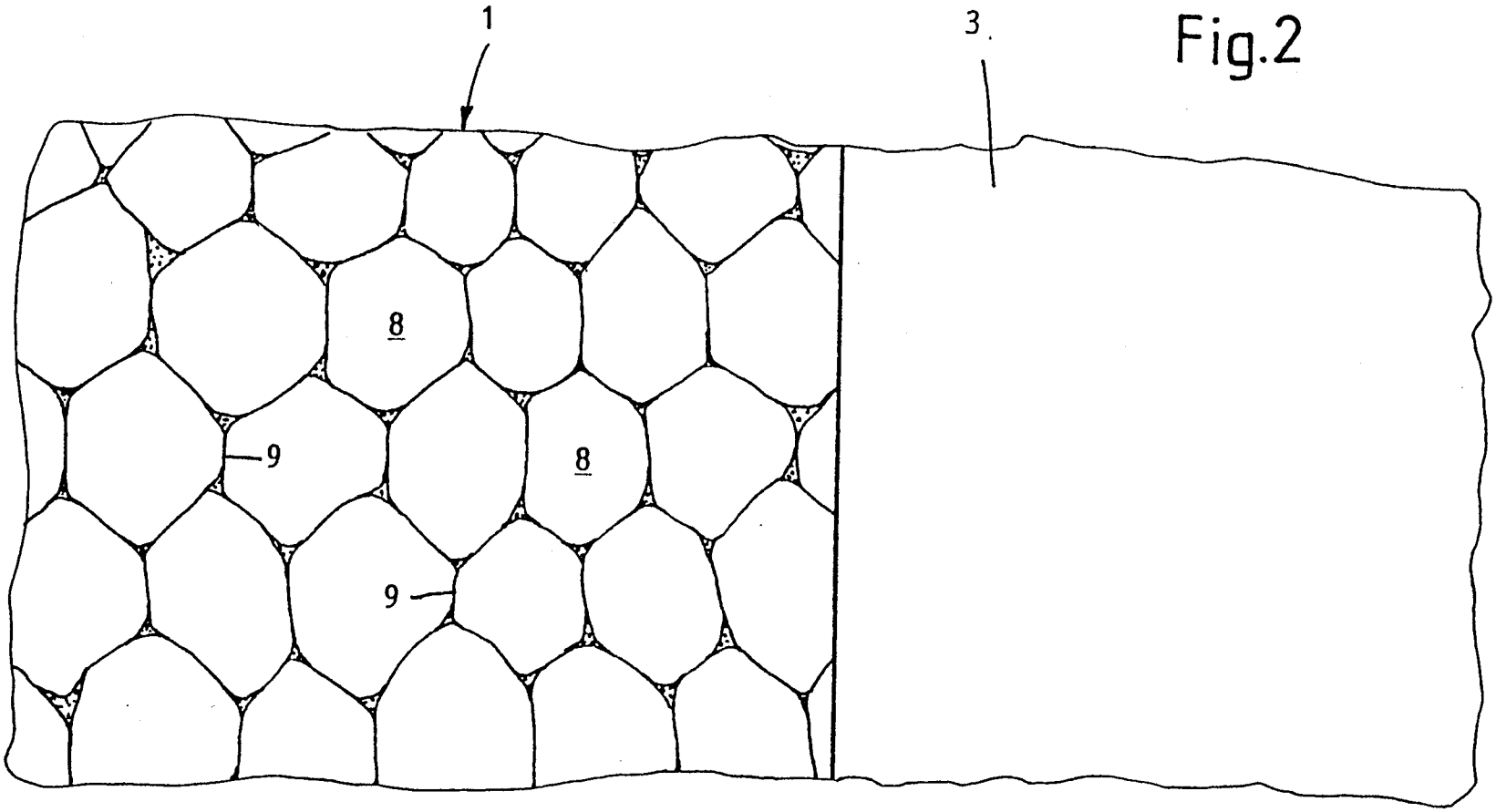
FIG. 2: A plan view of the area according to FIG. 1.

FIGS. 1 and 2 diagrammatically illustrate the structure of the plastic layer 1 of an inventive packing or seal, use examples for the same being shown in FIGS. 3 to 7 and 9 to 13. The right-hand part of the drawing shows a plastic layer 3 expanded on the machine part 2 and in which the voids 4 are theoretically arranged in the manner of a spherical packing. The voids 4 of a bottom void layer 6 have the same very limited spacing with respect to the base surface 5 on which the plastic layer 1 adheres resulting from void formation also taking place adjacent to said base surface 5. This very limited spacing results from the thin plastic layer 7 surrounding a void 4.

As opposed to the regular arrangement of a theoretical spherical packing, in a practical expanded plastic layer the voids 4 arranged over the bottom void layer are no longer at the same distance from the base surface 5, so that it is only possible by cutting off the bottom void layer 6 to form a regular arrangement of adjacent depressions 8 with the same depth and therefore obtain a honeycomb surface structure, as shown in FIG. 2. This surface structure should be as uniform as possible, so as to obtain an optimum labyrinth effect in uniformly distributed manner in the sealing gap of a seal or packing according to the invention. Honeycomb surface structures for sealing gaps produced purely mechanically from metallic material are e.g. described in U.S. Pat. No. 4,218,066. In order, in the case of the necessary substantial reduction of the expanded plastic layer, to obtain a residual layer with an adequate thickness of e.g. less than 0.5 mm, as is shown in the left-hand part of FIG. 1, it is necessary to make the voids correspondingly large, e.g. with a diameter of 0.8 mm. The necessary process conditions are adequately known, e.g. with regards to the mixing ratio of the plastic mixture to be expanded, the nature of the preparation of the surface to be coated, the surface structure, degreasing, temperature, etc.

The removal of the expanded plastic layer can take place in numerous different ways, e.g. by milling, turning or grinding. In view of a possible subsequent additional trueing on running in a machine, it must be insured that the ratio of the depth to the width of the depressions is adequate to achieve a good labyrinth effect in the sealing gap. This is e.g. achieved in that the voids are cut off by 30 to 60% of their diameter, so that the resulting depressions 8 are bounded relative to adjacent depressions 8 by freely terminating, diaphragm-like walls 9 directed approximately perpendicularly away from the base surface 5.

Figure 3:
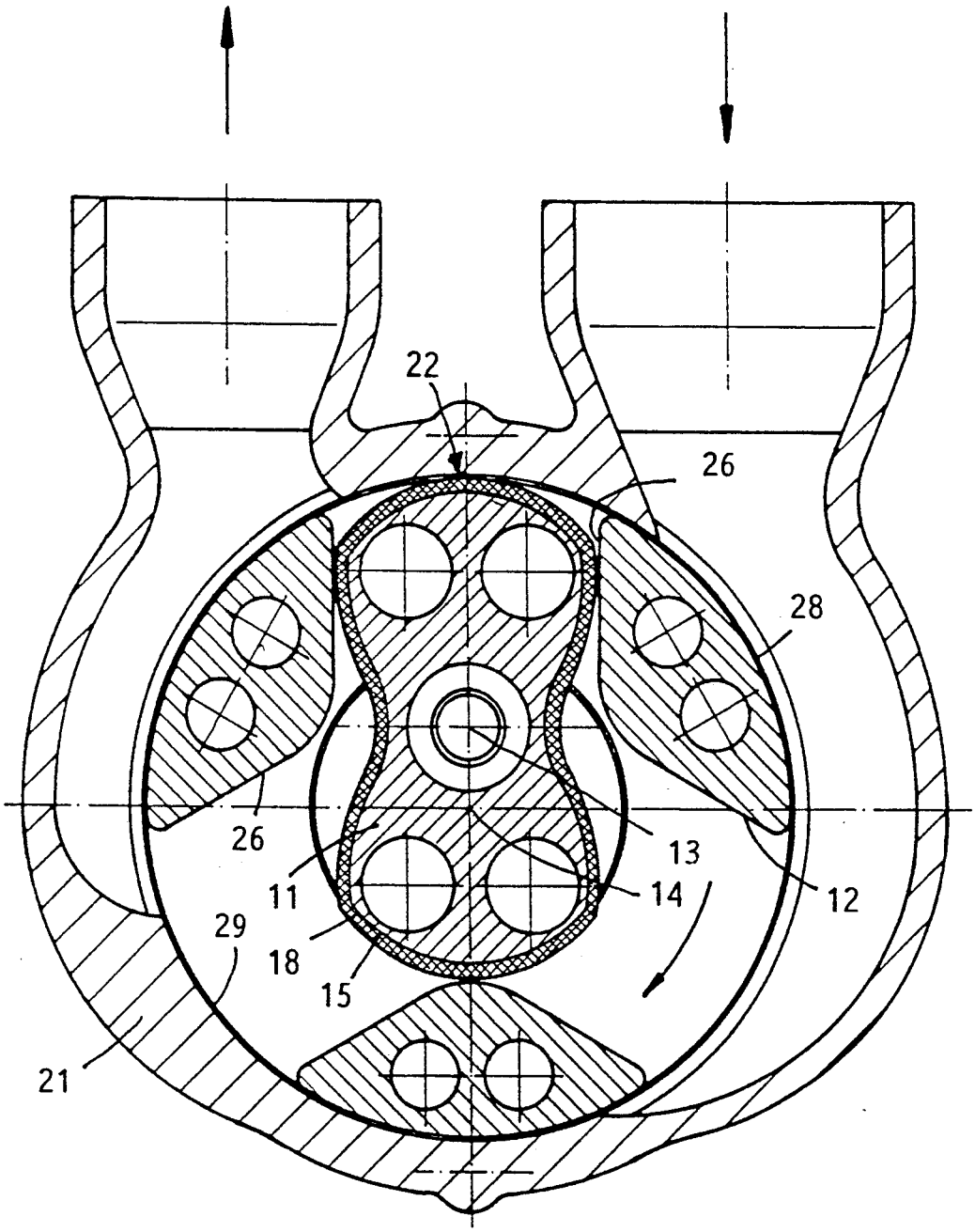
FIG. 3: A cross-section through a rotary piston machine, whose internal rotor has the plastic layer of an inventive seal.
Figure 4:
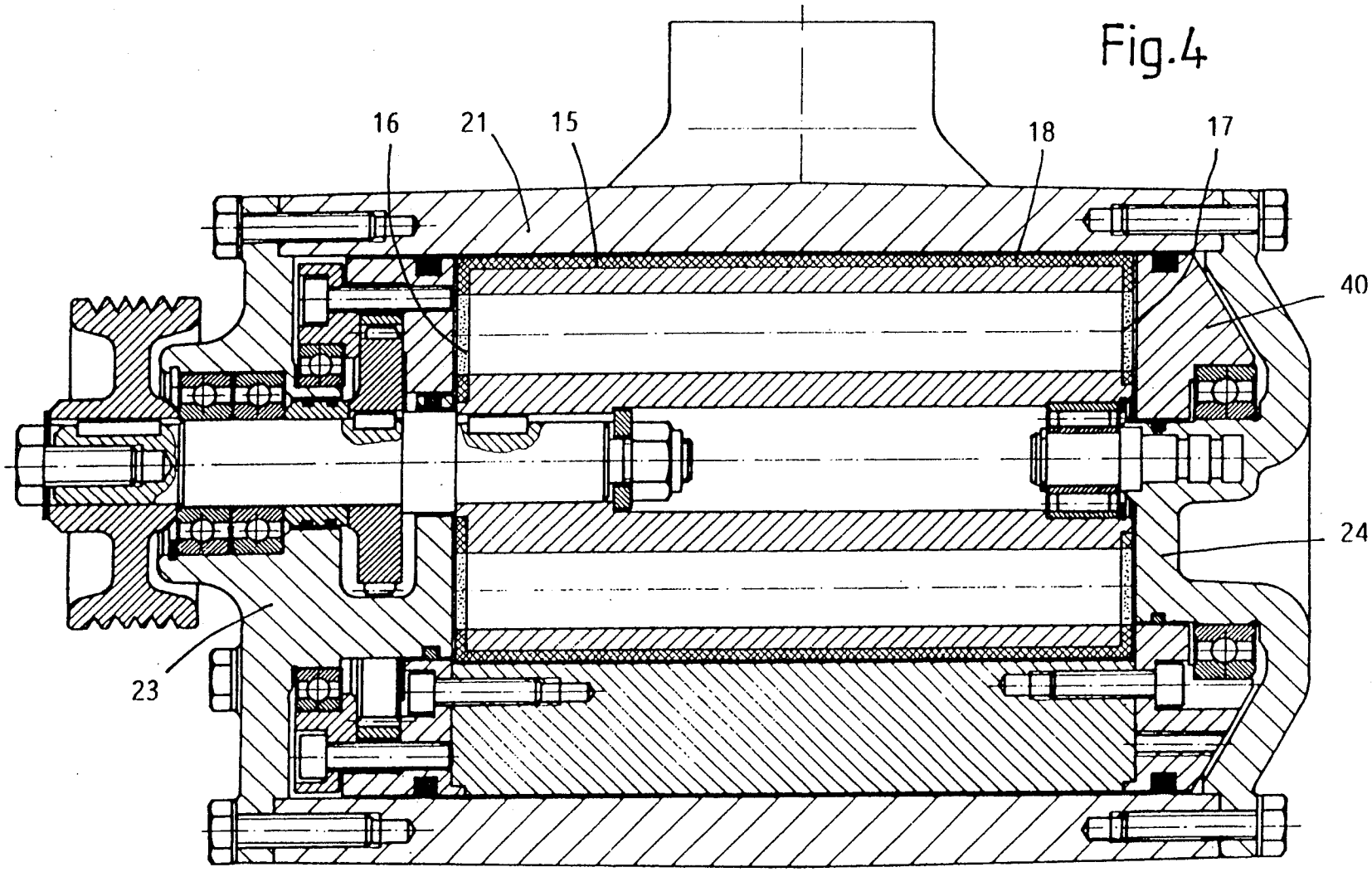
FIG. 4: A longitudinal section through the machine according to FIG. 3 in a plane containing the rotation axes.

The construction and operation of the rotary piston machines according to FIGS. 3 and 4 is adequately known from DE-A-34 32 915 (U.S. Pat. No. 4,714,417 and U.S. Pat. No. 4,801,255). It has an internal rotor 11 and an external rotor 12, which rotate about fixed geometrical axes 13, 14, so that high rotary speeds can be obtained. The circumferential surface 15 and the lateral surfaces 16, 17 of the internal rotor 11 are provided with the plastic layer 18 of an inventive seal, so that at least the plastic layer 18 covering the circumferential surface 15 is exposed to centrifugal forces, which act radially outwards in the direction of the opening 20 of the depressions 8, so that no contaminants can collect in the depressions 8 and the labyrinth effect is retained. The inventive seal of the internal rotor 11 is consequently provided relative to the circumferential part 21 of the machine casing in area 22, relative to the casing end parts 23, 24 and relative to the inner surfaces 26 of the external rotor 12. Although not shown in the represented embodiment, the plastic layer of an inventive seal can also be provided on the external rotor 12, preferably on its outer surfaces 28 or also on the inner surface 29 of the casing.

The FIGS. 5 to 8 show seals of a rapidly rotating machine shaft 30 relative to a stationary casing 31 and the plastic layer 32, 32' having the depressions 8 is preferably provided according to FIG. 5 directly on the shaft 30 or according to FIG. 6 on a sleeve 34 mounted on the shaft 30. In addition, according to FIG. 6 on the machine casing 31 is provided a countersleeve 35 of the seal, on which the plastic layer has optimum run in characteristics. According to FIG. 7 the plastic layer 32" of the seal is again provided on a sleeve 36, which is held in a casing bore 37. This external arrangement of the labyrinth-forming plastic layer corresponds to the known arrangement of a conventional labyrinth pattern 38 shown in FIG. 8.

Figure 10:
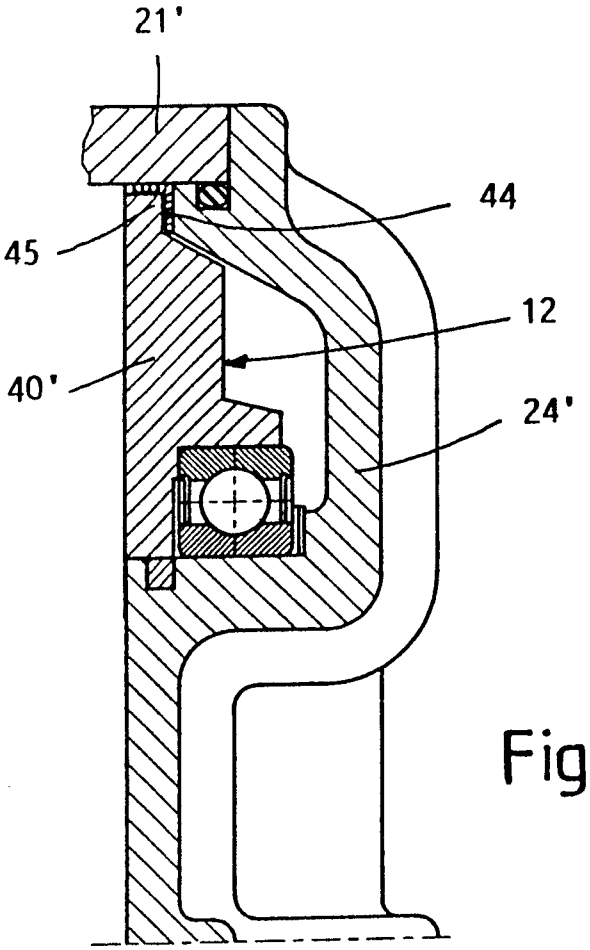
FIG. 10: A view corresponding to FIG. 9 with another variant of the arrangement of an inventive seal or packing.
Figure 9:
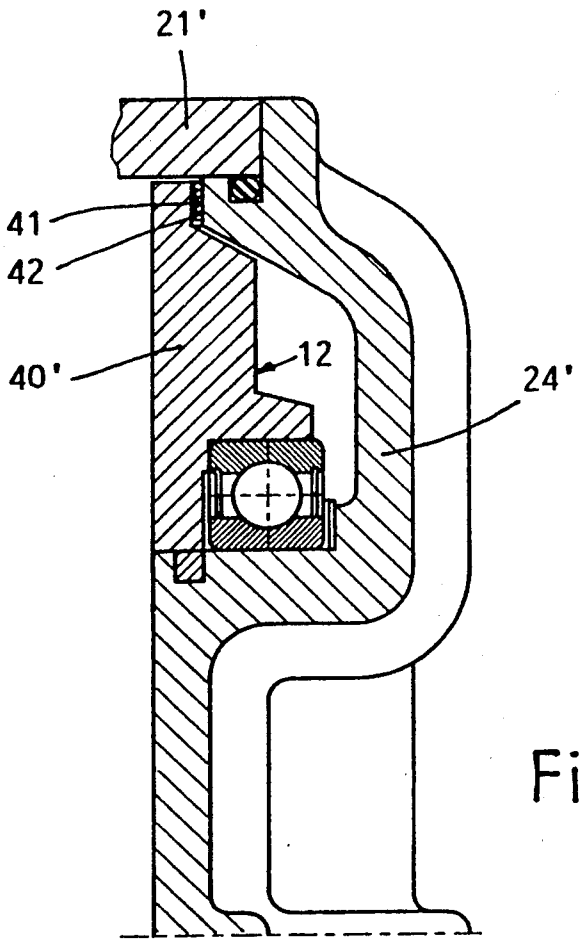
FIG. 9: A cross-section in the side wall region of a rotary piston machine of the type according to FIGS. 3 and 4.

FIGS. 9 and 10 show the seal of the lateral part 40' of the external rotor 12 of a rotary piston machine according to FIGS. 3 and 4 with respect to a casing end part 24'. According to FIG. 9 the plastic layer 41 in the form of a flat circular ring is placed in a plane directed radially to the rotation axis 14 of the external rotor 12 and runs parallel to a radially directed surface 42 of the casing end part 24'. In FIG. 10 the plastic layer 44 of the seal surrounds the corner region 45 of the external rotor in rectangular form and then continues in the represented manner in the circumferential surface of the external rotor 12.

Figure 11:
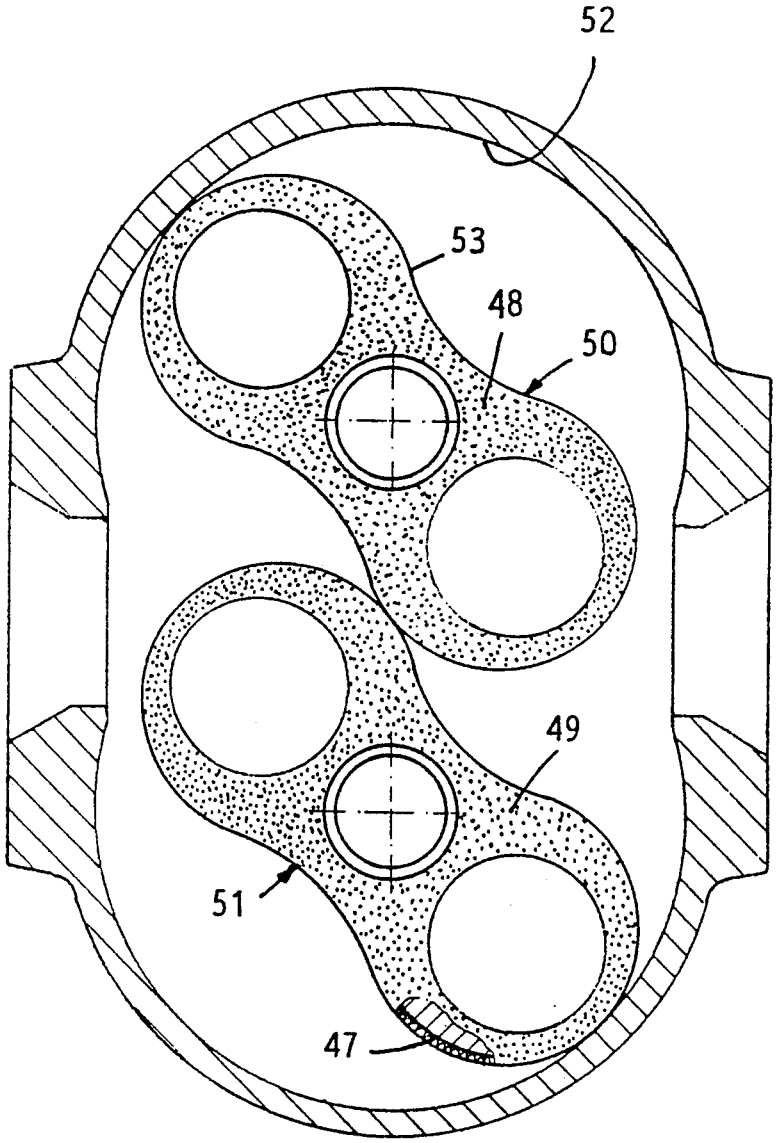
FIG. 11: A cross-section through a rotary piston machine of the Roots type.

FIG. 11 shows an inventive seal on an externally shafted rotary piston machine constructed as a Roots compressor. The plastic layer 47 is located on the radially directed lateral surfaces 48, 49 and on the circumferential surface e.g. of only one of the rotors 50, 51. It is obvious that the plastic layer can be divided up in different ways, in order to obtain an inventively advantageous seal. For example, part 52 of the casing inner surface can have a not shown plastic layer, along which moves the surface 53 of the rotor 50 not having this plastic layer.

Figure 12:
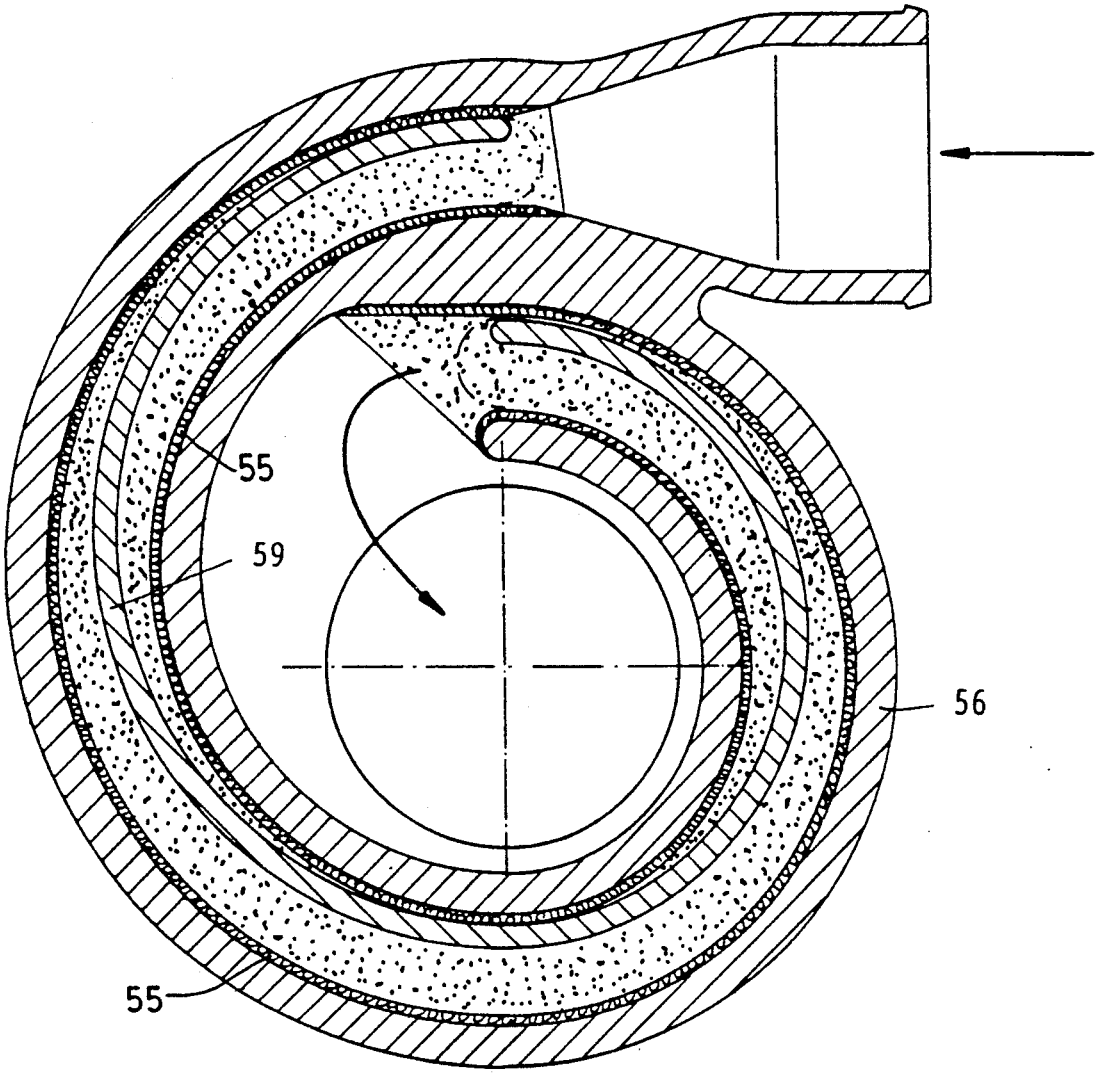
FIG. 12: A cross-section through a spiral compressor (G-compressor) with an inventive seal or packing.
Figure 13:
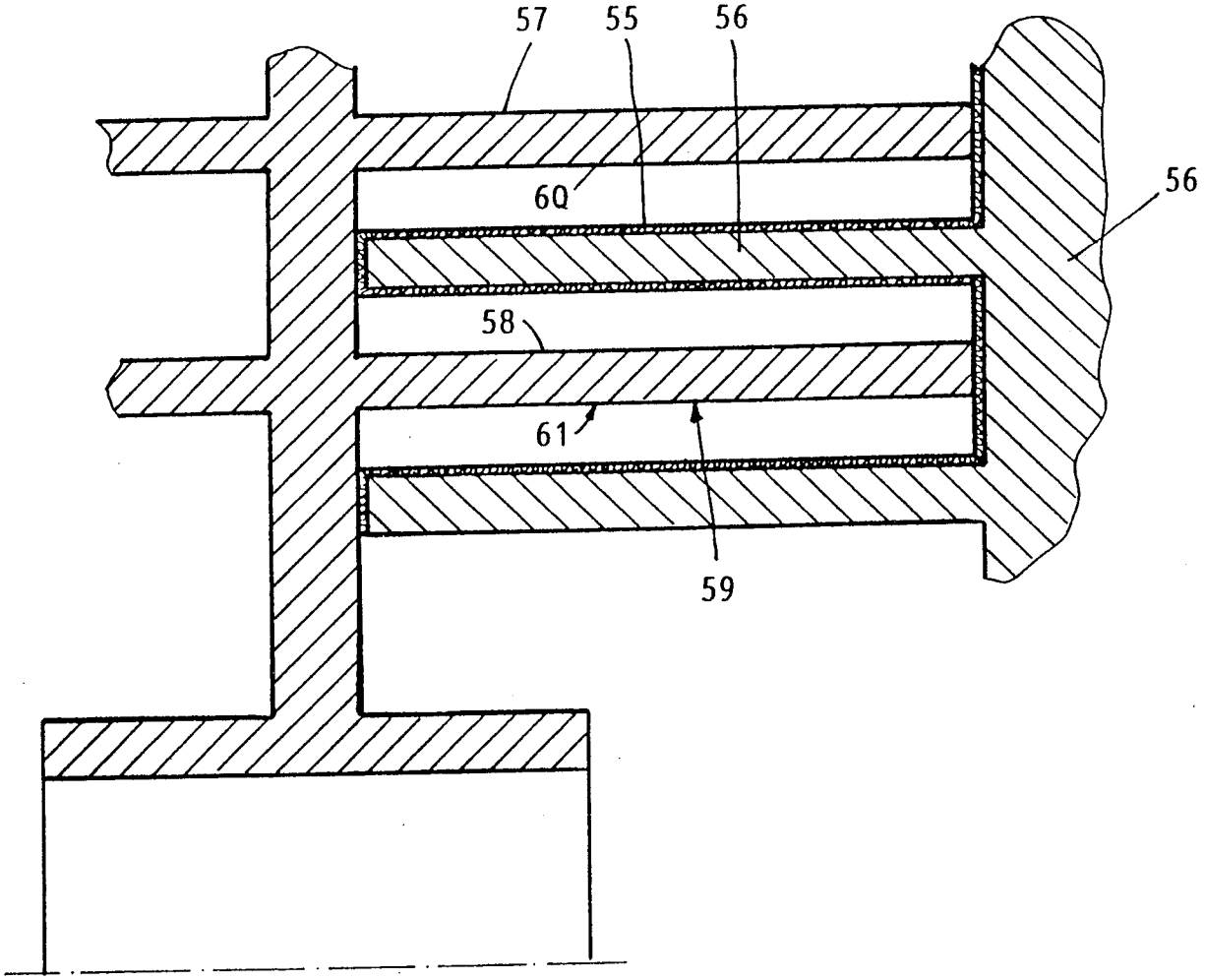
FIG. 13: An axially parallel section through an area of the spiral compressor according to FIG. 12.

In the embodiment according to FIGS. 12 and 13 the plastic layer 55 has in cross-section a continuous path along the meandering contour of the inner surface of the machine casing 56. This embodiment illustrates the advantage obtained through the possibility of fitting the plastic layer in painting processes. Also in the case of such a spiral compressor, the plastic layer is provided in not shown manner preferably on the outer surfaces 57, 58, 60, 61 of the rotor 59, so that its movement keeps clean the depressions 8 of the plastic layer 55.

A more detailed description of the construction of machines according to FIGS. 11 to 13 is not necessary, because large numbers thereof already exist.

The limited thermal insulation resulting from the plastic layer according to the invention is made clear by a comparison of the thermal conductivities of aluminium, from which e.g., is formed the rotor carrying the plastic layer, plastic and expanded plastic, the ratio being 1:0.001:0.0001. It must be born in mind that the thickness of the residual insulating plastic layer on the bottom of the depressions is negligible compared with the total thickness of the plastic layer having the depressions.

What is claimed is:

1. A seal for use between machine parts moving relative to one another along sealing, gap-forming and facing surfaces, the seal comprising: a plastic layer for adhering to a base surface on one of the sealing and facing surfaces, outwardly open depressions in close juxtaposition in the plastic layer having the form of closed voids of an expanded plastic structure which have been partly cut so as to be outwardly open, the partly cut voids extending at least close to the base surface, wherein at least most of the plastic layer is substantially free from closed voids.

2. A seal according to claim 1, wherein the depressions of the plastic layer are bounded to adjacent depressions by freely terminating diaphragm-like walls directed approximately perpendicular to the base surface.

3. A seal according to claim 1, wherein the depressions are bounded by a thin base wall made from a material which is the same as that of the plastic layer and which adheres to the base surface of the machine part forming an adhesive base of the plastic layer.

4. A seal according to claim 1, wherein the plastic layer having depressions is for location on surface areas of a rotary machine part exposed to centrifugal forces, so that the depressions are self-cleaning.

5. A seal according to claim 1, wherein the plastic layer has a thickness less than 0.5% of the machine part at its maximum dimension measured at right angles to the plastic layer.

6. A seal according to claim 1, for use on a rotary piston machine in which at least one rotor having a surface is enclosed in a casing having a surface and the seal is provided between at least one rotor and the casing wall, wherein, on one of the parts moving relative to one another, there is provided a plastic layer having a honeycomb-shaped arrangement of outwardly open depressions which extend at least close to the base surface to which the plastic layer adheres.

7. A seal according to claim 6, wherein the plastic layer is provided on the surface of at least one rotor on which the centrifugal force is directed away from the surface.

8. A seal for use between machine parts moving relative to one another along sealing, gap-forming and facing surfaces, the seal comprising: a plastic layer for adhering to a base surface on one of the sealing and facing surfaces, outwardly open depressions in close juxtaposition in the plastic layer having the form of closed voids of expanded plastic structure which have been partly cut so as to be outwardly open, the partly cut voids extending at least close to the base surface wherein at least most of the plastic layer is substantially free from closed voids, the depressions of the plastic layer being bounded to adjacent depressions by freely terminating diaphragm-like walls directed approximately perpendicular to the base surface.

* * * * *